US005279513A

United States Patent [19]

Connelly

[11] Patent Number: 5,279,513

[45] Date of Patent: Jan. 18, 1994

[54] ILLUMINATING TOY

[75] Inventor: Keith Connelly, Ithaca, N.Y.

[73] Assignee: I & K Trading Corporation, Vienna, Va.

[21] Appl. No.: 800,915

[22] Filed: Nov. 27, 1991

[51] Int. Cl.[5] ..... A63H 33/00

[52] U.S. Cl. ..... 446/219; 446/397; 446/485

[58] Field of Search ..... 446/219, 397, 404, 405, 446/406, 484, 485

[56] References Cited

U.S. PATENT DOCUMENTS

| | | | |
|---|---|---|---|
| 2,734,310 | 2/1956 | Christopher | 446/406 |
| 3,397,484 | 8/1968 | Ryan et al. | 446/906 X |
| 3,570,176 | 3/1971 | Palmer | 446/406 |
| 4,171,811 | 10/1979 | Meyer et al. | 496/405 X |
| 4,175,353 | 11/1979 | Pickett | 446/406 |
| 4,365,439 | 12/1982 | Litynski | 446/406 |
| 4,678,450 | 7/1987 | Scolari et al. | 446/485 X |
| 4,750,641 | 6/1988 | Hun | 446/406 X |
| 4,904,222 | 2/1990 | Gastgeb et al. | 446/405 |
| 5,059,150 | 10/1991 | Kuo | 446/405 |

FOREIGN PATENT DOCUMENTS

| | | | |
|---|---|---|---|
| 2199256 | 7/1988 | United Kingdom | 446/485 |

OTHER PUBLICATIONS

"Fairyland" Magic Light Up Wand, Brochure from Bantamlite, Inc., 1966,.

*Primary Examiner*—Robert A. Hafer
*Assistant Examiner*—Sam Rimell
*Attorney, Agent, or Firm*—Blum Kaplan

[57] ABSTRACT

An illuminated toy sword includes a handle. A light source mounted in said handle provides focused light. A light rod has a first end and a second end, the first end being optically coupled to the light source. The light source is focused upon the second end of the light rod, such that the light rod is substantially evenly illuminated.

22 Claims, 8 Drawing Sheets

ILLUMINATING TOY

BACKGROUND OF THE INVENTION

This invention is directed to a novel amusement device and, in particular, to an illuminating toy sword or wand that combines the use of light and sound to produce the effect of a light saber or magic wand.

Toy swords are well known in the art and have been made of grey plastic molded in the shape of the sword, to look like real metal swords. These swords have been designed to look realistic, to attract attention and to captivate children. However, these toy swords suffer from the disadvantage that they have no play value beyond their use as an imitation sword. Also, prior art toy swords do not stimulate the imagination of the child, encourage the use of the sword by the child or maintain the interest of the child over extended periods of time.

To overcome this deficiency toy manufacturers have developed toy light sabers or laser light swords for children. These toy swords included a flashlight with a plastic sword member covering the light bulb. While serving a purpose, these swords were large, bulky and less than adequate. Such swords suffered from a disadvantage that they provide non-uniform illumination and do not provide a desired scrolling effect to add realism to the toy.

Further, toy magic wands are also known in the art. These wands consist merely of handles with a wand attached thereto that contains sparkle or other types of mylar pieces and a regular incandescent light bulb therein to cause illumination. However, a disadvantage of these wands is that they do not provide the magical sound effects normally associated with the familiar effect sought to be obtained or uniform illumination of the wand with an aesthetically pleasing illuminated tip at the end thereof.

Accordingly, an improved toy light sword or magic wand that provides enhanced play value by combining light and sound to provide a realistic light saber or magic wand is desired.

SUMMARY OF THE INVENTION

Generally speaking, in accordance with the instant invention, a toy light sword is provided. The toy light sword includes a handle and a light source supported therein. A light rod is optically coupled to the light source. A sound generator is disposed in the handle for generating a sound. A circuit activates the sound generator and light source simultaneously to provide an illusion of a real magic wand or sword.

In one embodiment, the light source further includes a scrolling feature such that the light appears to the eye to travel along the sword away from the light source. The handle of the toy sword contains three controls. A first control causes the light to scroll along the light rod and the sound generator to produce a sound associated with scrolling light synchronized to the scrolling action. A second control causes the sound generator to produce a sound that a light sword might make when moved side-to-side during use. A third control deactivates the light source and causes the sound generator to produce a sound associated with light sword deactivation synchronized thereto. The length of time that it takes to scroll out and scroll back the light may be increased or decreased according to a predetermined desired length of time.

Accordingly, it is an object of this invention to provide an improved amusement device in the form of an illuminated toy sword or toy wand.

A further object of the instant invention is to provide an amusement device which enables a child to use his imagination to create play scenarios using the magical amusement device.

It is another object of the invention to provide a toy that incorporates a scrolling light and the sound associated therewith.

Another object of the invention is to provide an amusement device that incorporates light and sound to create magical illusions.

A still further object of this invention is to provide an amusement device that imparts increased play value to the user.

Still another object of the invention is to provide toy light swords and wands with greater realism.

Still other objects and advantages of the invention will in part be obvious and will in part be apparent from the specification.

The invention accordingly comprises the features of construction, combination of elements and arrangement of parts which will be exemplified in the constructions hereinafter set forth, and the scope of the invention will be indicated in the claims.

BRIEF DESCRIPTION OF THE DRAWINGS

For a fuller understanding of the invention, reference is had to the following description, taken in connection with the accompanying drawings, in which.

DETAILED DESCRIPTION OF THE PREFERRED EMBODIMENTS

Reference is first made to FIGS. 1-5, wherein a light sword, generally indicated as 20 and including a handle assembly (handle) 22 and a light blade assembly 150 is depicted.

Figure 1:
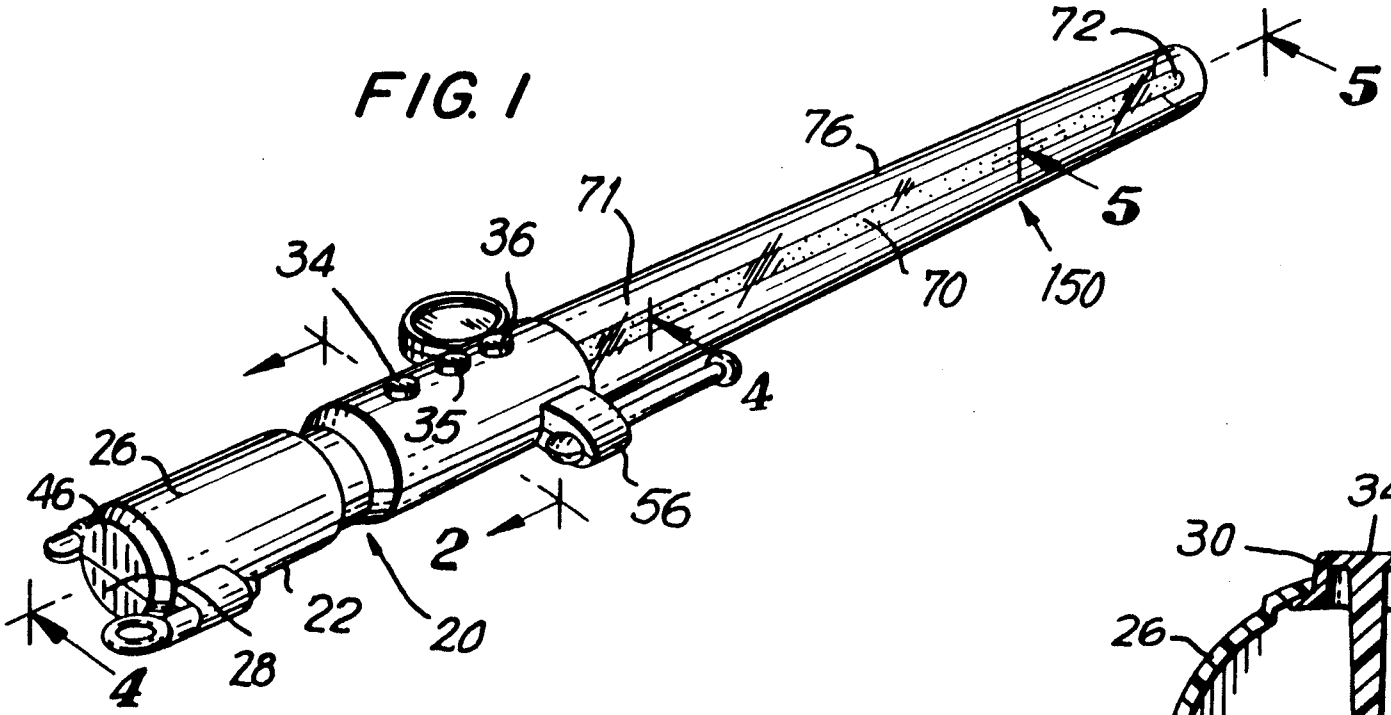
FIG. 1 is a perspective view of an illuminating sword constructed in accordance with the instant invention.
Figure 2:
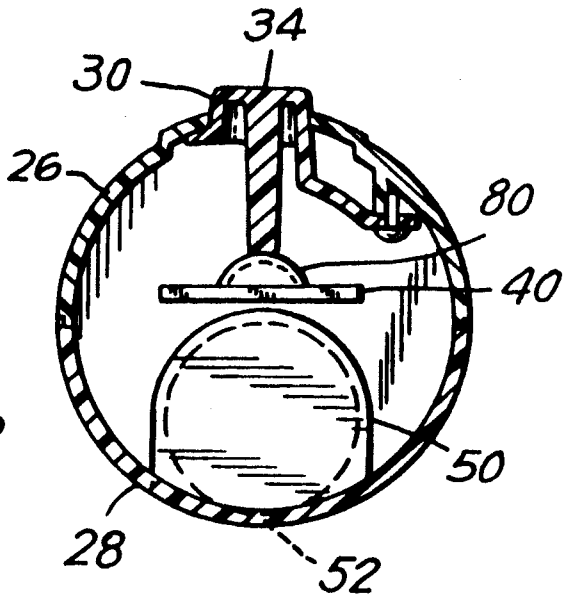
FIG. 2 is a cross-sectional view taken along line 2—2 of the illuminated sword of FIG. 1.
Figure 3:
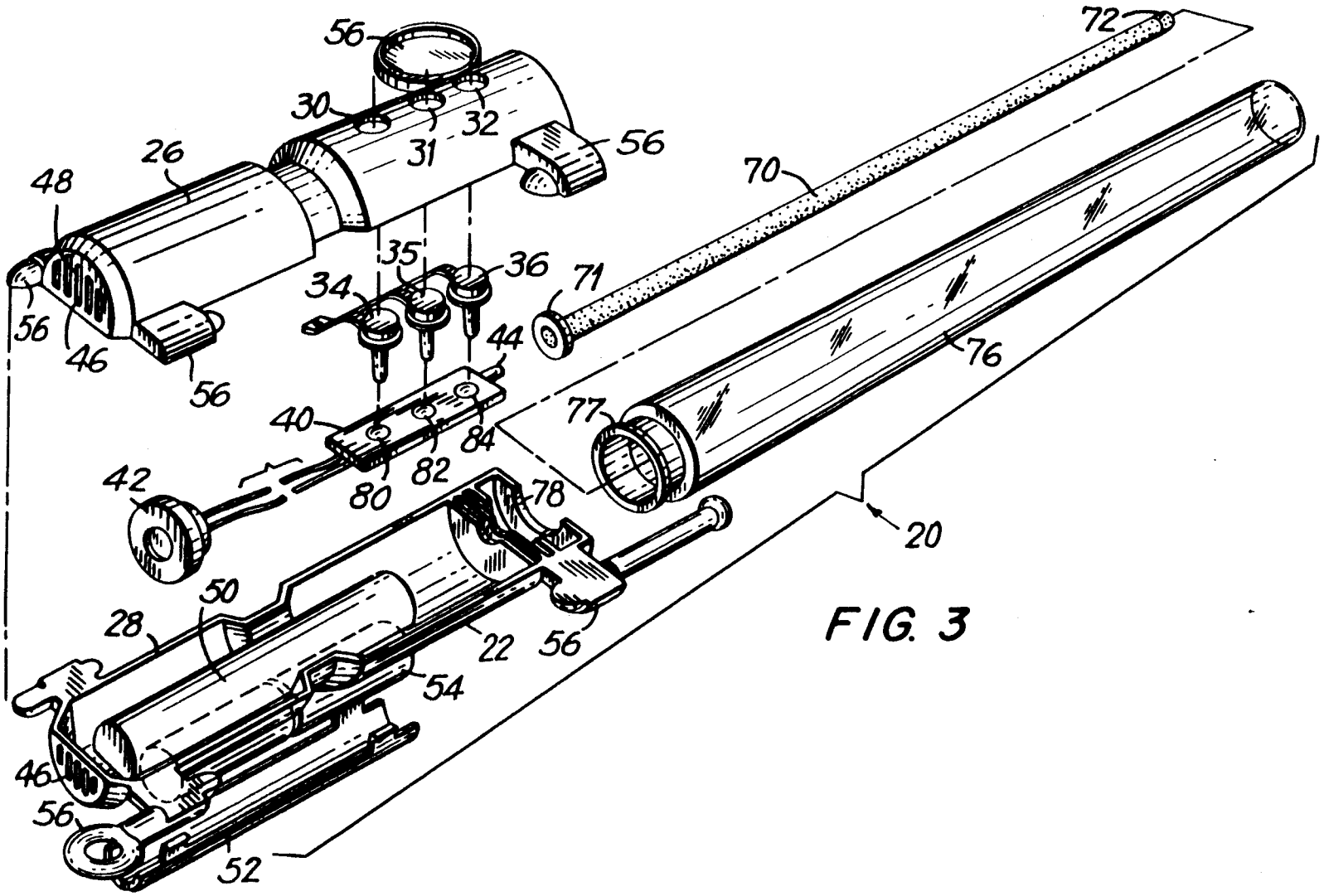
FIG. 3 is an exploded view of the illuminated sword of FIG. 1.
Figure 4:
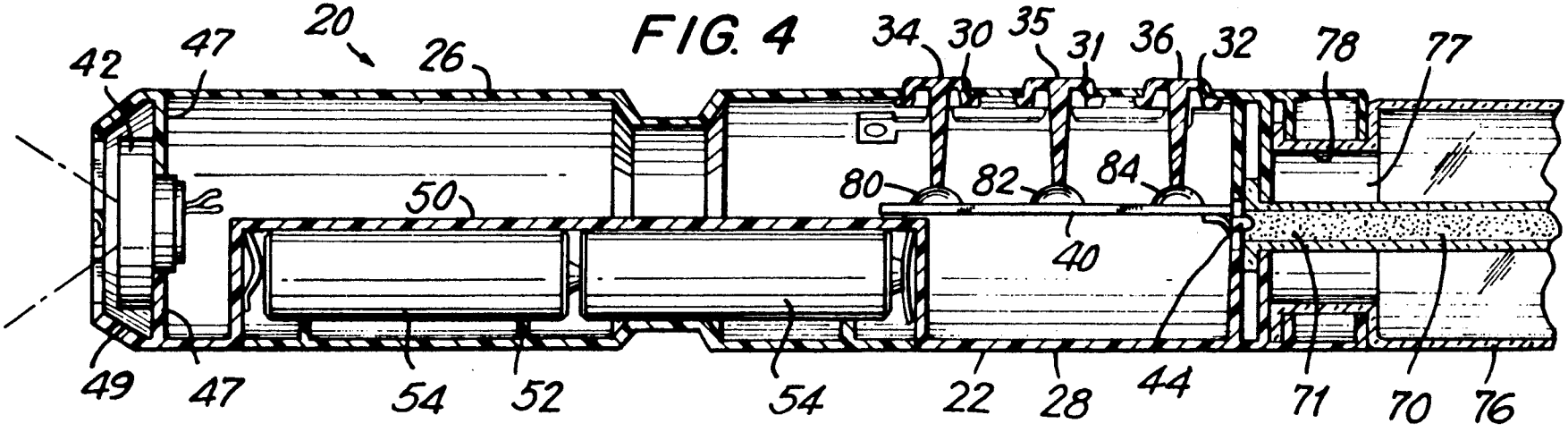
FIG. 4 is a partial sectional view taken along line 4—4 of the illuminating sword of FIG. 1.
Figure 5:
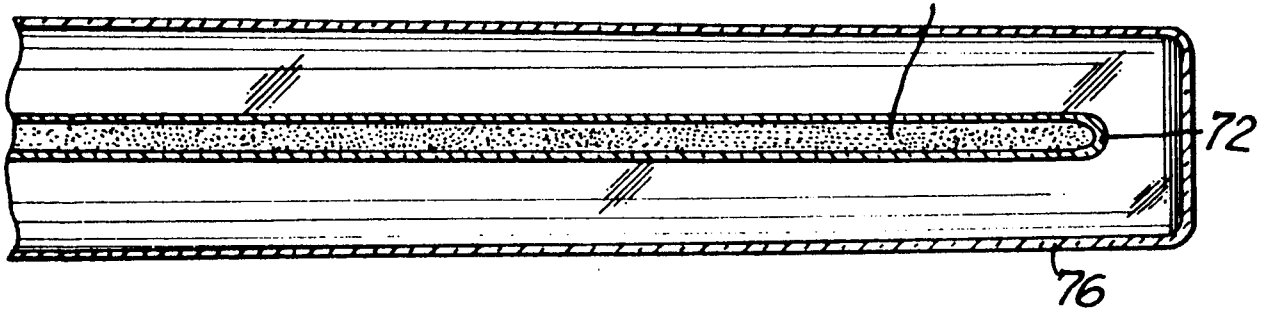
FIG. 5 is a partial sectional view taken along line 5—5 of the illuminating sword of FIG. 1.
Figure 6:
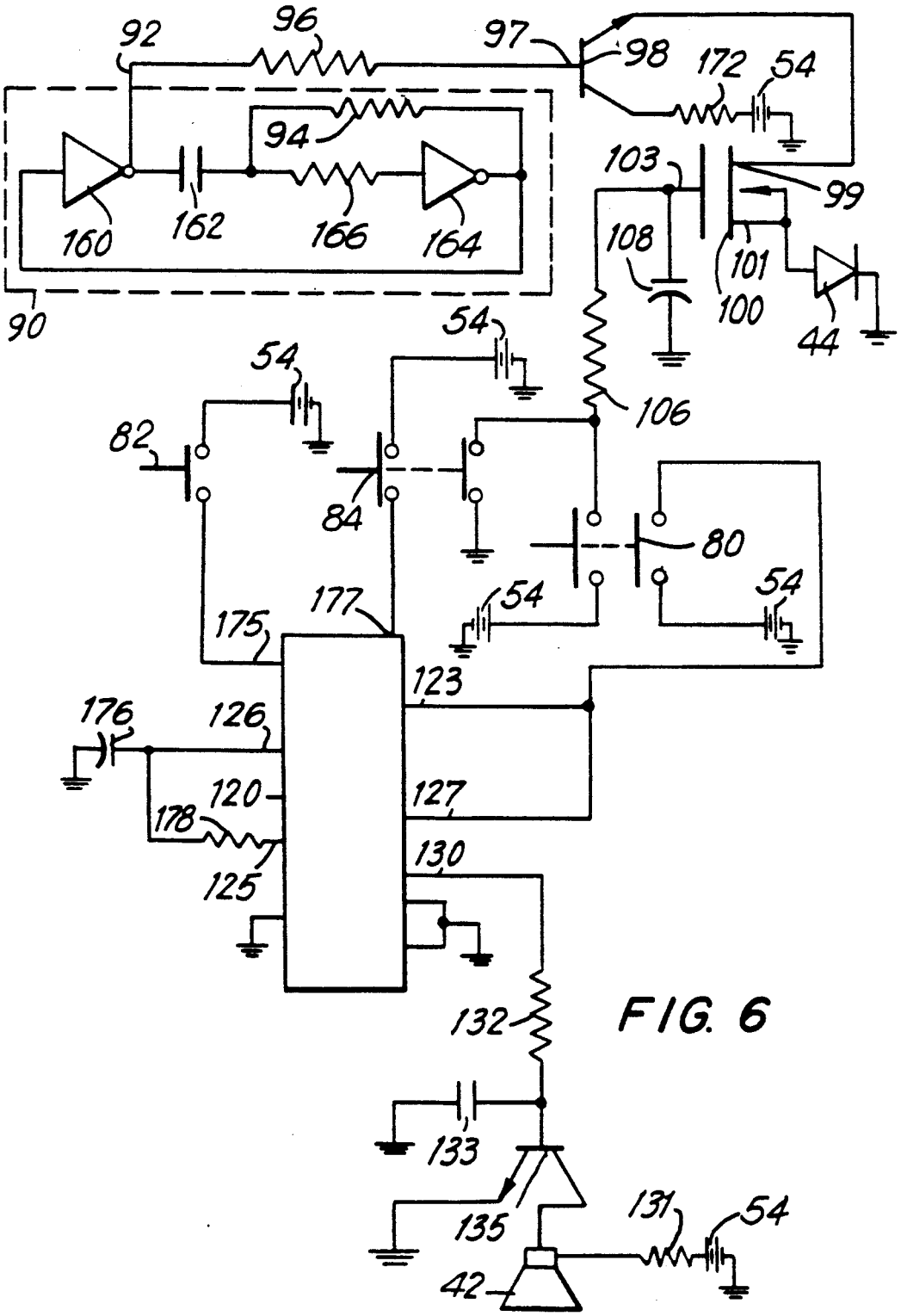
FIG. 6 is a schematic diagram of the light and sound circuitry of a first embodiment of the invention.
Figures 7, 8:
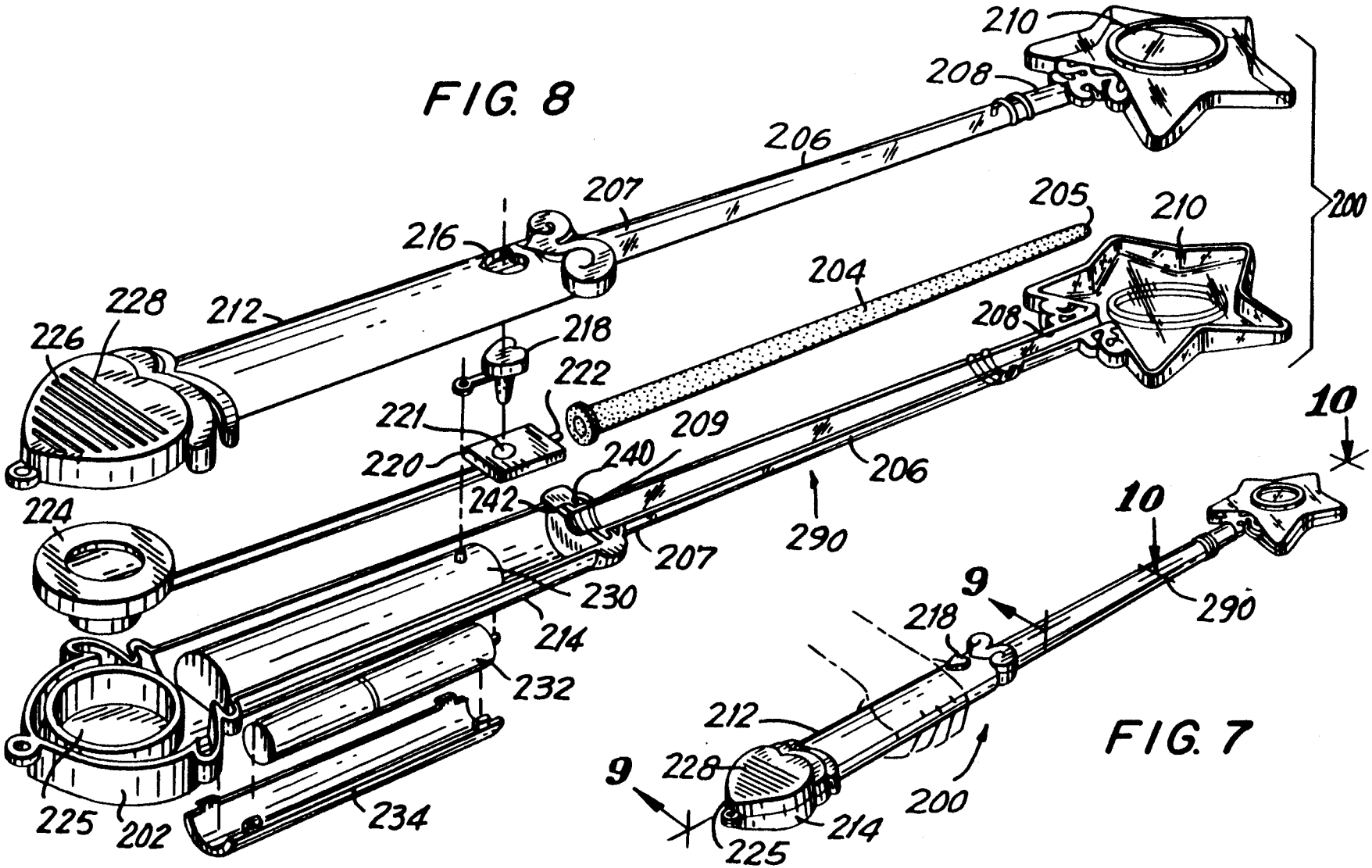
FIG. 7 is a perspective view of an illuminating wand constructed in accordance with the invention.
FIG. 8 is an exploded view of the illuminating wand of the present invention.
Figure 9:
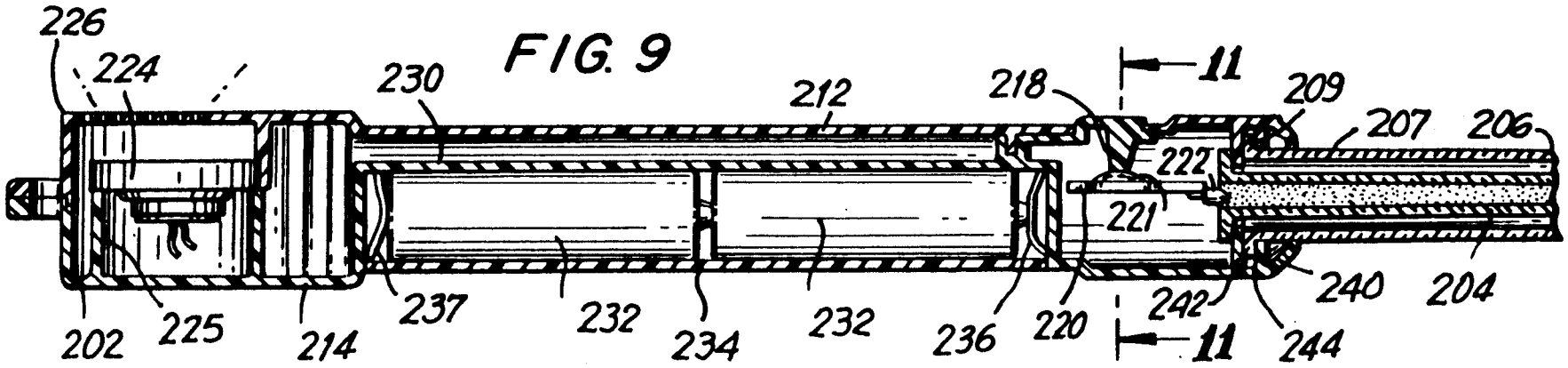
FIG. 9 is a partial sectional view taken along line 9—9 of the illuminating wand of FIG. 7.
Figure 10:
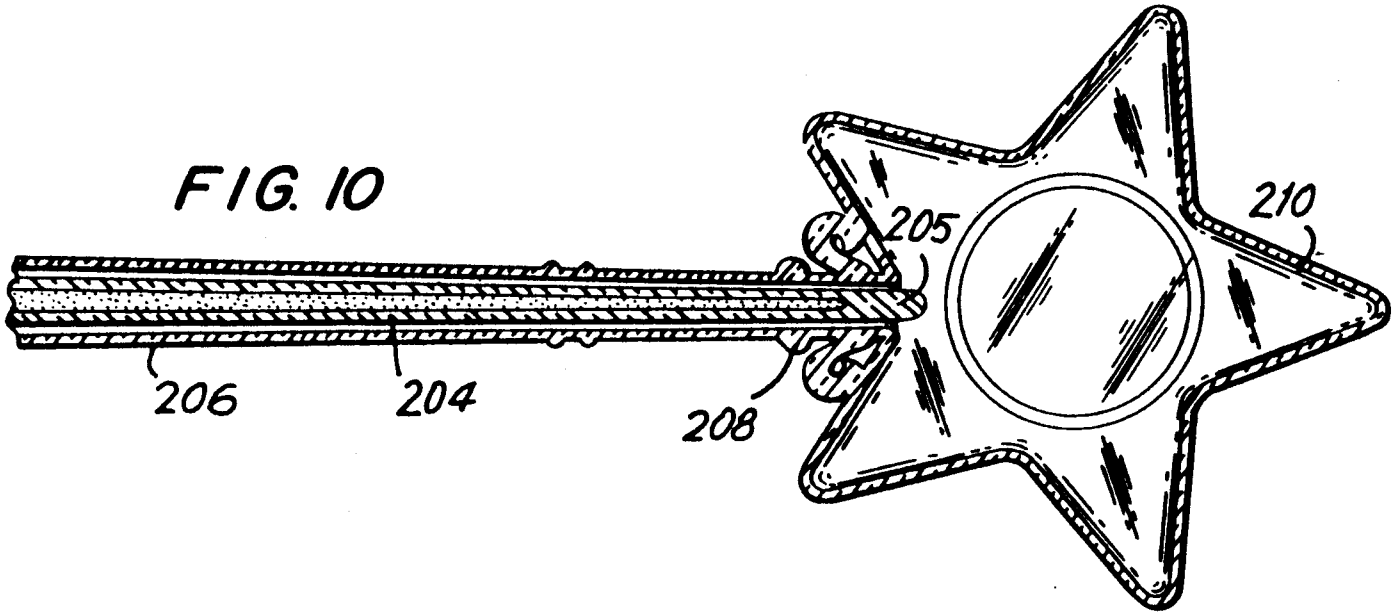
FIG. 10 is a partial sectional view taken along line 10—10 of the illuminating wand of FIG. 7.
Figure 11:
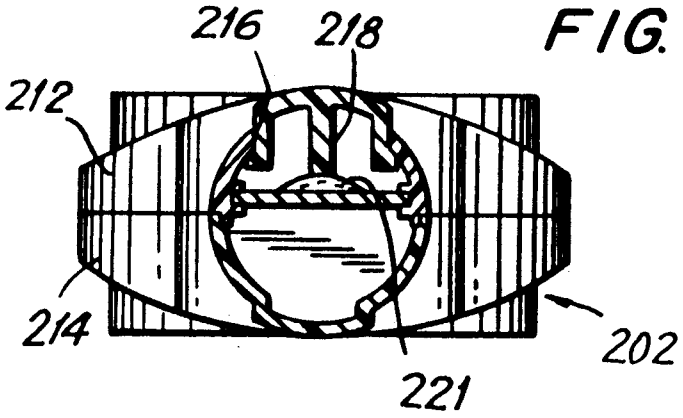
FIG. 11 is a cross-sectional view taken along line 11—11 of the illuminating wand of FIG. 9.
Figure 12:
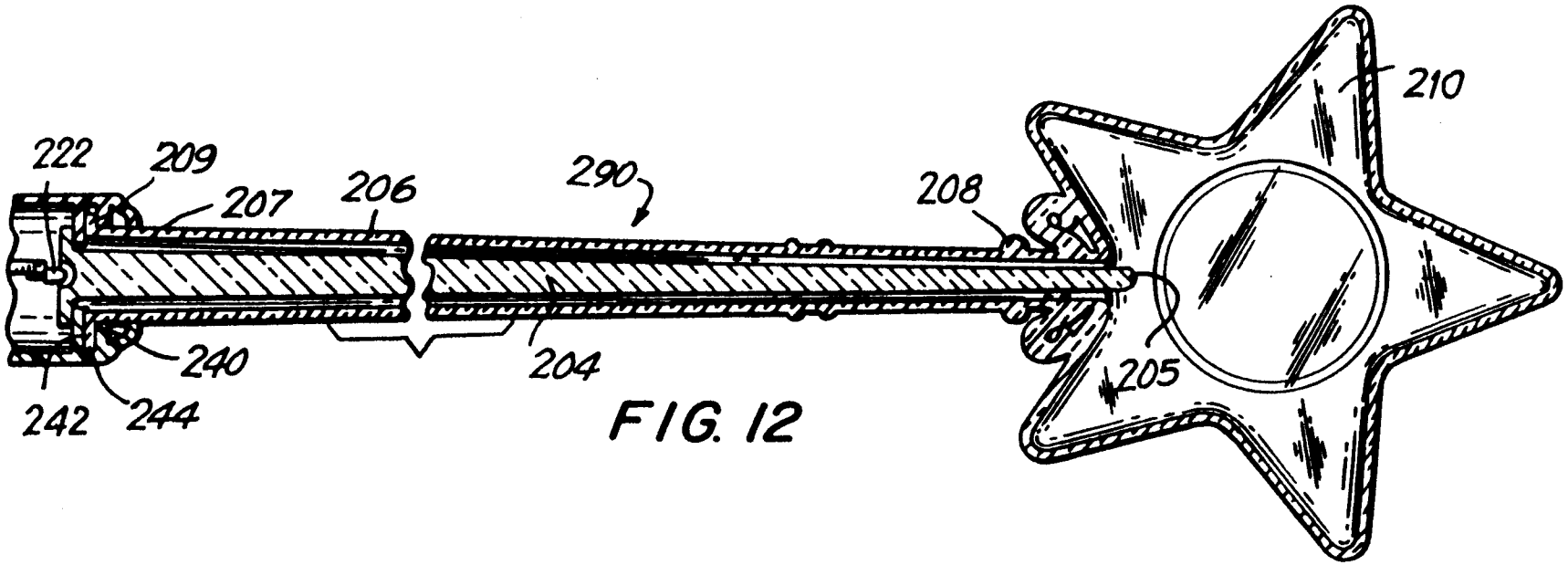
FIG. 12 is a partial sectional view of the wand constructed in accordance with the invention.

Handle 22 of sword 20 has an upper portion 26 and a lower portion 28. Handle 22 of sword 20 is preferably formed of a thermoplastic that resists breakage. Upper portion 26 is formed with bores 30, 31, 32 therethrough for receiving a plurality of push switches 34, 35, 36. A printed circuit board 40, the circuit of which is shown in detail in FIG. 6, is supported within handle 22. A lensed light emitting diode (LED) 44 is electrically coupled to printed circuit board 40. Printed circuit board 40 activates speaker 42 and controls the current flow to LED 44.

Handle 22 is further provided with an internally extending flange 47 defining a well 49. A speaker 42 electrically coupled to the circuit of printed circuit board 40 is supported within well 49. A first end 46 of handle 22 is formed with grooves 48 to allow the sound from speaker 42 to radiate out of handle 22.

A battery housing 50 is integrally formed within a lower portion 28 of handle 22. Batteries 54 fit in battery housing 50 and a battery housing cover 52 snaps on and off of battery housing 50 maintaining batteries 54 in place. Battery housing cover 52 is preferably formed of the same break-resistant thermoplastic as handle 22. Handle 22 is further equipped with aesthetically pleasing members 56, which are of the same theme as the type of sword or light saber, which add enhanced play value for the user.

Push switches, 34, 35, 36 activate the circuit of printed circuit board 40 and are displaceable between a first position, wherein they do not contact circuit board 40, and a second position, wherein they are in contact with circuit board 40. Printed circuit board 40 includes dome switches 80, 82, 84. Push switches 34, 35, 36 contact circuit board 40 at dome switches 80, 82, 84, respectively.

Light blade assembly 150 includes a translucent light rod 70 preferably formed of a thermoplastic such as blow molded polyethylene or the like which is partially resistant to light. The blow molded polyethylene light rod 70 provides a pathway for the light from LED 44 to travel. LED 44 is positioned within a first proximate end 71 of light rod. The lens of the LED 44 focuses the light at a second distal end 72 of light rod 70. Accordingly, hot spots or bright spots may be formed at the first end 71 near LED 44 and at second distal end 72. Light rod 70 is formed with a rough surface (a surface with many nicks or grooves therein) to prevent light from shining directly through the sides of light rod 70. The nicks and grooves or rough spots on the surface are capable of receiving the light waves and reflecting and scattering the light waves away from the light rod. In this way, each nick or groove that reflects a light wave away from the light rod appears to the human eye to be illuminated in the area of that nick or groove. This is due to the fact that the human eye does not see that actual light wave, but only sees the reflection and scattering of the light off an object, in this case the nicks or grooves in the light rod. Accordingly, light rod 70 has substantially uniform illumination across the length of the light rod. Additionally, light rod 70 is formed of a material providing some resistance to light, i.e. the light travel distance (the portion of the light rod that appears to be illuminated to the viewer) is directly related to beam intensity. Therefore, light beams from LED 44 of low intensity will not appear to travel the entire length of light rod 70. As more energy is provided by LED 44, the light will appear to travel a greater distance along light rod 70 so that the distal end of the beam will appear to be advancing towards second end 72 of light rod 70 providing the illusion of a moving or "scrolling" light.

Light assembly 150 includes a sword blade 76 formed with a collar 77 adapted to be received in an opening 78 formed in handle 22. Light rod 70 is disposed within sword blade 76. Sword blade 76 is made of a thermoplastic material that is not opaque, so that the light radiating from light sword 70 can cause sword blade 76 to become substantially uniformally illuminated.

When light sword 20 is turned ON, there is a scrolling effect of the light along light rod 70. As will be described in detail below the scrolling effect is due to a continuous increase in current levels provided to LED 44. The brightness of LED 44 is directly proportional to the current fed therethrough. As will be discussed hereinbelow, as push switch 34 is depressed, a capacitor charges and the charge on the capacitor is directly proportional to the light emitted by LED 44. Accordingly, as the light intensity emitted by LED 44 increases, a light beam appears to scroll toward second distal end 72 of light rod 70. Simultaneously therewith, printed circuit board 40 causes speaker 42 to produce a sound associated with a scrolling light sword. Push switch 35 is then pushed and speaker 42 is caused to output the sound of a light sword in motion. Push switch 36 is then pushed turning OFF LED 44, extinguishing the light in light rod 70 and causing speaker 42 to output a sound associated with the turning OFF of a light sword.

Reference is next made to FIG. 6, wherein the light and sound circuit of printed circuit board 40 is illustrated. An astable clock 90 includes a first inverter 160 which provides an output to a capacitor 162. Capacitor 162 is coupled to a second inverter 164 through a resistor 166. Capacitor 162 also provides an input to inverter 160 through resistor 94. A feedback input is also provided to inverter 160 by inverter 164.

Inverter 160 outputs signal 92 which oscillates at approximately 18 Hz. Signal 92 provides an oscillating input to the base of gating transistor 98 through a resistor 96. The collector of transistor 98 is coupled to batteries 54 through current limiting resistor 172. The drain 99 of a metal oxide semiconductor field effect transistor (MOSFET) 100 is coupled to the emitter of transistor 98. LED 44 is coupled between the source 101 of MOSFET 100 and ground.

Battery 54 is coupled to the gate 103 of MOSFET 100 through a double throw dipole switch 80 and a resistor 106. A capacitor 108 is coupled between ground and gate 103. Switch 84 is also a double throw dipole switch which is coupled between ground and resistor 106. The gate 103 of MOSFET 100 receives power from battery 54 through switch 80 and resistor 106. Capacitor 108, also coupled to gate 103, stores electrical energy supplied by batteries 54 when switch 80 is closed. In an exemplary embodiment, capacitor 108 has a capacitance of 1 $\mu$F and resistor 106 has a resistance of 100 K$\Omega$. However, these values may vary in accordance with the effect desired.

Basic astable clock 90 outputs a clock signal 92. The clock signal 92 is a square wave of approximately 18 Hz. Resistor 94 is varied until output signal 92 is 18 Hz. The 18 Hz signal is preferred because it is below the persistence of vision producing a strobe effect that the eye can barely detect. Accordingly, when the circuit is on, LED 44 will strobe and an animated light effect will be seen by the user.

Signal 92 is input to the base 97 of bipolar junction transistor (BJT) 98 through current limiting resistor 96. When base 97 of BJT 98 receives a high signal, BJT 98 is turned ON and current flows between the emitter and collector of BJT 98 substantially unimpeded. However, current does not flow to LED 44 unless MOSFET 100 is also turned ON.

Switch 80 turns MOSFET 100 ON. When switch 102 is depressed, a positive signal from battery 54 is input through resistor 106 charging capacitor 108. Since the scrolling effect is dependent on the current applied to LED 44, when resistor 106 is increased in resistance the scrolling effect is slower, and when it is lower in value the scrolling effect is quicker. The amount of current that may flow between drain 99 and source 101 of MOSFET 100 is directly proportional to the voltage at gate 103. The voltage at gate 10 is the voltage stored in capacitor 108. Accordingly, when capacitor 108 is at ground potential, no current flows from drain 99 to source 101 of MOSFET 100. However, after depression of push switch 102, capacitor 108 stores energy. When push switch 102 is only depressed for a short amount of time, capacitor 108 does not fully charge and only a small amount of current can flow between drain 99 and source 101 of MOSFET 100. Accordingly, LED 44 illuminates with little intensity. Therefore, LED 44 cannot effectively illuminate the entire length of light rod 70 from first end 71 to second end 72 and light rod 70 appears less than fully illuminated. However, as push switch 102 is closed for a longer period of time, capacitor 108 fully charges and current freely flows between drain 99 and source 101 of MOSFET 100. Therefore, LED 110 illuminates with a high intensity and light rod 70 becomes fully illuminated providing the appearance of the light scrolling along light blade assembly 150 from a proximate end to a distal end.

MOSFET 100 acts as a voltage controlled resistor and causes the desired scrolling effect of light rod 70. Further, after capacitor 108 is fully charged, push switch 102 no longer needs to be depressed, and diode 110 stays illuminated, strobing with an 18 Hz frequency as determined by clock pulse 92 from basic astable clock 90. MOSFET 100 does not drain capacitor 108. Accordingly, battery power is conserved.

Switch 84 turns LED 44 OFF. Capacitor 108 is discharged through resistor 106 to ground when switch 84 is depressed closing the circuit. Gate 103 is at ground potential and no current flows between drain 99 and source 101 of MOSFET 100. Accordingly, LED 44 is non-illuminated.

Reference is now made to the sound generating portion of the circuit of printed circuit board 40. A sound chip 120 stores sound data at various addresses therein which may be pre-input through audio inputs at the time of manufacture. Sound chip 120 may be chip number UM 5000 manufactured by the UMC Corporation of Taiwan.

Sound chip 120 receives a first input at terminal 123 and a second input at terminal 127 from batteries 54 through switch 80. Batteries 54 are also coupled directly to sound chip 120 through switches 84 and 82.

Sound chip 120 is also grounded at four leads. Capacitor 176 is grounded on one side and the other side is coupled to terminal 126 of sound chip 120 and through resistor 178 to terminal 125. In an exemplary embodiment, capacitor 176 has a value of approximately 6800 pF and resistor 178 has a value of 680 KΩ. These values may vary in accordance with the sound sample speed desired.

A transistor 135 is coupled to chip 120 through an RC circuit formed by a resistor 132 and capacitor 133. The collector of transistor 135 is coupled to speaker 42 which in turn is coupled in series with a current limiting resistor 131. Battery 54 is grounded. In an exemplary embodiment, resistor 124 has a value of 100 KΩ, capacitor 133 has a capacitance of 0.15 pF and resistor 132 has a value of between 0 and 18 Ωdepending upon the desired volume.

The sound circuitry operates simultaneously with the operation of LED 44 when switch 80 is depressed. A high signal is sent through inverter 122 and current limiting resistor 124. Accordingly, a high signal is input to terminal 123 of sound chip 120. Simultaneously, a high is input to sound chip 120 at terminal 127. This input combination accesses the address for the appropriate sound on sound chip 120 and lead 130 of sound chip 120 outputs the desired sound signal. This sound signal is input at the base of BJT 13 through resistor 132. Battery 54 drives speaker 42 through current limiting resistor 131. The sound signal input at the base of the BJT 135 gates BJT 135 causing current to flow through speaker 42 and through the collector and emitter of BJT 135 to ground. The sound is emitted from speaker 42 for as long as switch 80 is depressed and turns off when switch 80 is released.

To produce a sound corresponding to the motion of a light sword, switch 82 is depressed. This provides a single high input to sound chip 120 at input terminal 175. The sound is emitted for as long as switch 82 is depressed and is terminated when switch 82 is released.

When switch 84 is activated, a positive signal is input to sound chip 120 at input terminal 177. Accordingly, the address of the appropriate sound signal is accessed and output to lead 130 to activate speaker 42 as noted hereinabove. The sound output by speaker 42 when push switch 84 is depressed is a sound that is associated with the light sword becoming inactivated. The sound is produced simultaneously with LED 44 being turned OFF providing the illusion of a real light saber. However, in a preferred embodiment, chip size and expense can be conserved by using the same terminal of sound chip 120 and the same sound for activation and deactivartion of the light sword.

By providing a light sword which illuminates the blade while simultaneously providing sounds associated with an illuminated blade, a light sword of increased realism providing an enhanced play value provided by a more realistic light sword is provided. By providing a mechanism to cause the light of the blade to scroll along the light sword, a toy light sword which captures the imagination of the user and provides even greater realism thus enhancing the play value even further is provided.

Reference is now had to FIGS. 7-12, wherein an illuminating wand, generally indicated as 200, constructed in accordance with a second embodiment of the invention is provided. An illuminating wand 200 has a handle assembly (handle) 202 and a light wand assembly 290 coupled to handle 202

Handle 202 has a top portion 212 and a bottom portion 214. Top portion 212 is formed with a bore 216 therein adapted to receive switch 218 therethrough.

Handle 202 of wand 200 is formed of a thermoplastic material, such as polyvinyl chloride (PVC) and top portion 212 couples with bottom portion 214 by a snapfit closure. However, top portion 212 and bottom portion 214 may close by any other preferable manner. Bottom portion 214 of handle 202 is equipped with a first speaker housing section 225. Top portion 212 of handle 202 is equipped with a speaker housing section 226 which is formed in a decorative shape. A speaker 224 is disposed within speaker housing sections 225, 226. For exemplary purposes, a heart shape is illustrated. Grooves 228 are cut within speaker housing 226 to allow sound waves to emanate therefrom.

A battery housing 230 for housing batteries 232 is formed in bottom portion 214 of handle 202. Battery housing cover 234 is provided to maintain batteries 232 within housing 230. Battery housing cover 234 is preferably formed of a thermoplastic material such as PVC, but may be formed of other materials.

Figure 13:
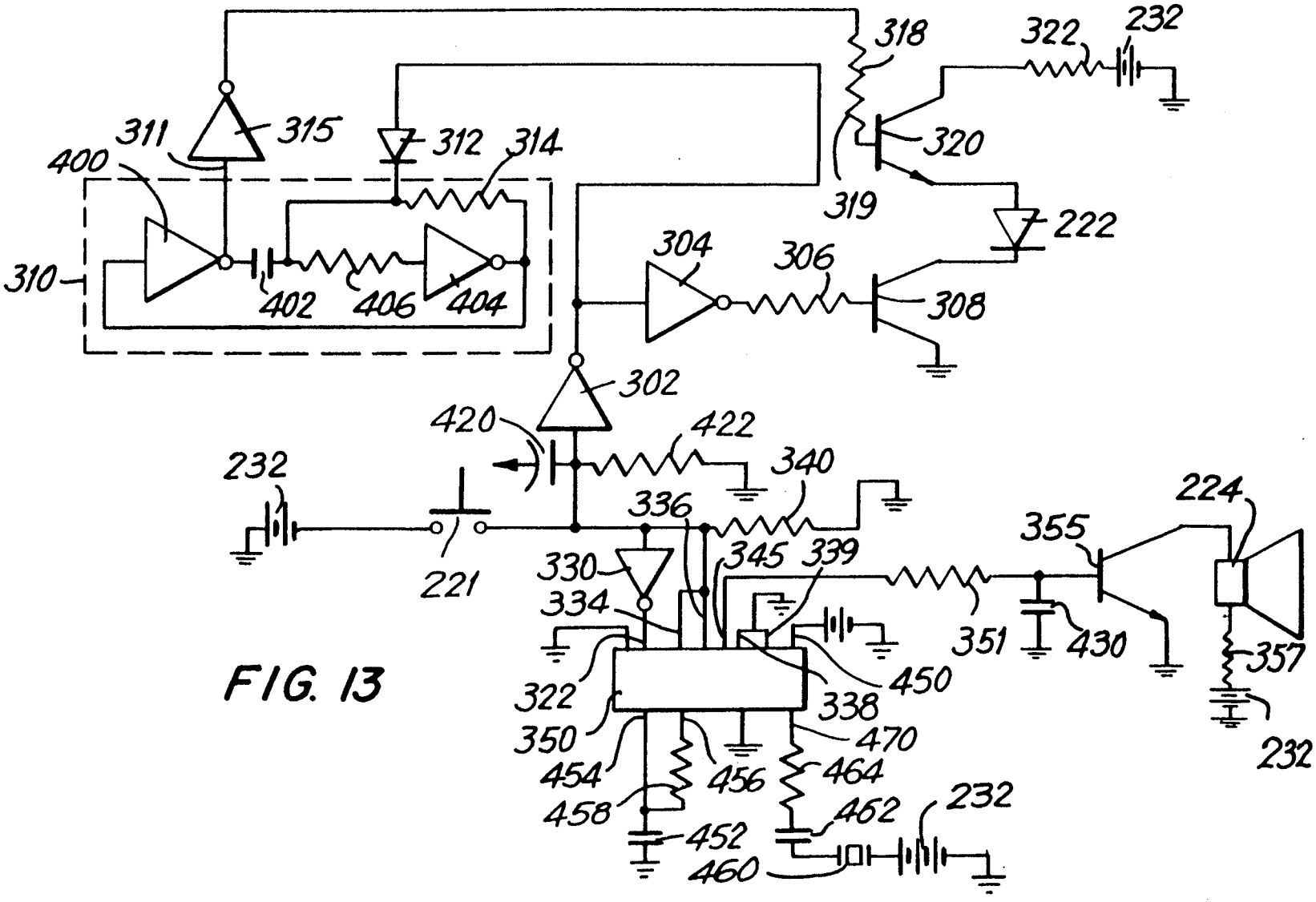
FIG. 13 is a schematic diagram of the circuitry constructed in accordance with a second embodiment of the present invention.

A printed circuit board 220, the circuit of which is shown in detail in FIG. 13, is supported within handle 202. Printed circuit board 220 is electrically coupled to speaker 224. LED 222 is also coupled to the circuit of printed circuit board 220 and is driven thereby. LED 222 is a lensed LED. Batteries 232 are electrically coupled to printed circuit board 220 by connection terminals 236, 237.

Switch 218 is movable between a first position in which switch 218 contacts domed switch 221 of printed circuit board 220 and a second position in which switch 218 is not in contact with printed circuit board 220. When switch 218 contacts printed circuit board 220, LED 222 is turned ON. When contact stops, LED 44 is turned OFF. Further, switch 218 causes speaker 224 to produce sounds associated with a magic wand when LED 222 is illuminated.

Light wand assembly 290 includes a translucent light rod 204 having roughed sides. Light rod 204 provides a pathway for the light of LED 222. Light rod 204 need not exhibit a scrolling characteristic. A decorative wand member 206 is adapted to contain light rod 204 therein.

Light rod 204 is enveloped by decorative wand member 206. Decorative wand member 206 has a first end 207 coupled to handle 202 and a second end 208. An aesthetically pleasing head 210 is formed at second end 208 of decorative wand member 206. Head 210 is star-shaped, by way of example, and illuminates when light rod 204 is fully illuminated.

LED 222 illuminates light rod 204. As described above in connection with light sword 20, the lens of LED 222 is focused at second end 205 of light rod 204. Light rod 204 is formed of a translucent thermoplastic material that may have either a white or pink color to add aesthetic quality for the user. Preferably, light rod 204 is blow molded thermoplastic. Again, since light needs a final resting place to illuminate a surface, the surface of light rod 204 is roughed or has many grooves in it becoming translucent to provide a resting place for the light to shine upon, so that light rod 204 illuminates evenly along its surface.

Handle 202 is formed with two (2) upstanding walls 240, 242 defining a groove 244. Groove 244 receives flange 209 of first end 207 of decorative wand 206.

Reference is next made to FIG. 13, wherein the circuitry for wand 200 is disclosed. The circuit of printed circuit board 220 drives light emitting diode 222 and speaker 224.

An astable clock 310 includes a first inverter 400 which provides an output to a capacitor 402. Capacitor 402 is coupled to a second inverter 404 through a resistor 406. Capacitor 402 also provides an input to inverter 400 through resistor 314. A feedback input is also provided to inverter 400 by inverter 404. In an exemplary embodiment, the resistance of resistor 314 is substantially ten times that of resistor 406. Resistor 314 has a resistance of 250 KΩ, while resistor 406 has resistance of 25 KΩ. Capacitor 64 has a capacitance of 0.22 μF.

Inverter 315 receives the output of inverter 400 which is a signal which oscillates at approximately 18 Hz. Inverter 315 provides an oscillating input to the base 319 of gating transistor 320 through resistor 318. The collector of transistor 320 is coupled to battery 232 through a current limiting resistor 322. Battery 232 is positioned between resistor 322 and ground.

LED 222 is coupled between the emitter of transistor 320 and the collector of a second transistor 308. The emitter of transistor 308 is coupled to ground. Battery 232 is also coupled through a current limiting resistor 410 to switch 221. Switch 221 is coupled at one end to a capacitor 420 which is coupled to a resistor 422, which is coupled to ground. In an exemplary embodiment, capacitor 420 has a capacitance of 0.22 μF and resistor 422 has a resistance of about 250 KΩ. Capacitor 420 provides an input to an inverter 302 which is coupled to astable clock 60 through diodes 312. Inverter 302 also provides an input to inverter 304 which is coupled to the base of transistor 308 through resistor 306.

Reference will first be made to the portion of the circuit for driving LED 222. Upon depression of switch 221, node 301 receives a high signal. Accordingly, a high signal is input into inverter 302 and a low is output therefrom. Further, inverter 304 converts the low signal into a high signal that is fed through current limiting resistor 306 and turns bipolar junction transistor (BJT) 308 ON. When a BJT is referred to as being ON, it means that a high is input at the base. When a BJT is ON, current may flow between the emitter and collector with only a minimal drop in voltage, commonly 0.2 volts. If BJT 320 is not ON, current normally cannot flow through LED 222 or BJT 308.

Basic astable clock 310 receives the output of inverter 302 which is fed through diode 312. Diode 312 is provided to gate oscillator 310 off when switch 300 is open circuited. Oscillator 310 outputs a square wave signal. Resistor 314 may be varied to provide the appropriate frequency of oscillation. Output signal 311 is fed through inverter 315 to provide square wave signal 316. Signal 316 is fed through current limiting resistor 318 and is fed into base 319 of BJT 320. When base 319 of BJT 320 is high, BJT 320 is turned ON and current may flow between emitter and collector.

When BJT 308 and BJT 320 are both on, current may flow between batteries 232 through current limiting resistor 322 across emitter and collector of BJT 320 through LED 222, thereby illuminating LED 222, and through collector and emitter of BJT 308 to ground. However, if either transistor 320 or transistor 308 is turned OFF, no current can flow through this section of the circuit and LED 222 will not illuminate.

Signal 316 is provided as a square wave input oscillating at approximately 18 Hz which, as discussed hereinabove with respect to the sword, produces a strobic effect making the wand appear animated to the eye.

The remaining portion of the circuit of FIG. 13 is the sound circuit. Inverter 330 is driven either by battery 234 through resistor 410, or by capacitor 420. Inverter 330 receives a high signal and outputs a low signal to terminal 332 of sound chip 350. Sound chip 350 stores sound data at various addresses therein which may be pre-input through audio inputs during the time of manufacture. Sound chip 350 may be chip No. UM 5000 manufactured by the UMC Corporation of Taiwan, or the like. Sound chip 350 also receives two high signals input from leads 334 and 336 coupled to capacitor 420. A resistor 422 is disposed between leads 334, 336 and ground. Chip 350 is also grounded at two other leads.

A transistor 355 is coupled to chip 350 through an RC circuit formed by a resistor 351 and capacitor 430. The collector of transistor 355 is coupled to speaker 280 which in turn is coupled in series with a current limiting resistor 357, battery 232 and ground. The emitter of transistor 355 is coupled to ground so that when transistor 355 is enabled, a current passes from battery 78 through speaker 224 to ground is provided. A sound signal generated by sound chip 350 corresponding to the sound stored at the address indicated by the inputs of inverter 330 and terminals 334, 336 is input to transistor 355 through the RC circuit formed by resistor 351 and capacitor 430 causing sound to be generated by speaker 280 in response to the sound signal. In an exemplary embodiment, resistor 340 has a value of 100 KΩ, capacitor 430 has a capacitance of 0.15 pF and resistor 351 has a value of between 0 and 18 Ω, depending upon the desired volume.

Sound chip 350 receives input from battery 232 at terminal 450. Capacitor 452 is grounded on one side and the other side is coupled to sound chip 120 in parallel to terminal 454 and through resistor 458 to terminal 456. In an exemplary embodiment, capacitor 452 has a value of 6800 pF and resistor 458 has a value of 680 KΩ. However, these values may vary in accordance with the sound sample rate desired.

Battery 232 is connected to piezo sensor 460 which is connected to capacitor 462. The other side of capacitor 462 is connected to resistor 464 which is connected to terminal 470. Piezo sensor 460 activates upon impact to provide a second magical sound when wand 200 strikes an object. In a preferred embodiment, capacitor 462 is 1 μF and resistor 464 is adjustable to vary the sensitivity of piezo sensor 460.

As can clearly be seen from the Figures, this invention incorporates the use of a lensed diode focused at the far end of a light rod, the light rod being formed with a rough surface such that the light emanating from the LED may equally light the entire light rod. The LED strobes at a rate of approximately 18 Hz, so that an animated strobing effect is given to the light rod or decorative casing covering the light rod. Further, sounds associated with a magic wand are incorporated with the light rod and are emitted simultaneously with the lighting of the wand to add enhanced play value for the user. The combination of light and sound produces a combination which creates an illusion of realism that provides enhanced play value for the user.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An illuminated toy, comprising a handle, light source means mounted in said handle for emitting focused light, elongated light pathway means extending from said handle and having a first end and a second end, said first end being optically coupled to said light source means for providing a pathway for said focused light; said focused light being focused in the direction of said second end of said elongated pathway means, and variable light intensity means coupled to said light source means for varying the intensity of said focused light so that said focused light appears to be moving along said elongated light pathway.

2. The illuminated toy of claim 1, wherein said variable light intensity means includes selectively actuated circuit means operatively coupled to said light source means for varying said intensity of said focused light emitted by said light source means so that said focused light appears to be moving along said elongated pathway means.

3. The illuminated toy of claim 2, wherein said selectively actuated circuit means includes a metal-oxide-semiconductor field-effect transistor.

4. The illuminated toy of claim 1, wherein said light source means includes a lensed light emitting diode.

5. The illuminated toy of claim 1, wherein said elongated pathway means is a light rod, said light rod being light resistant in inverse relation to the intensity of said emitted focused light.

6. The illuminated toy of claim 5, wherein said light rod is formed of thermoplastic.

7. The illuminated toy of claim 1, and including sound generating means mounted in said handle for producing a sound simultaneously with said light source means emitting said focused light.

8. The illuminated toy of claim 5, wherein said light rod is translucent.

9. The illuminated toy of claim 7, wherein said sound generating means generates a first sound associated with movement of said toy.

10. The illuminated toy of claim 7, wherein said sound generating means generates a second sound associated with said light with deactivation of said toy simultaneously with deactivation of said light source means.

11. The illuminated toy of claim 1, including a head coupled to said second end of said elongated light pathway means.

12. The illuminated toy of claim 11, wherein said head is star shaped.

13. The illuminated toy of claim 11, wherein said light source means and said elongated light pathway means illuminate said head.

14. The illuminated toy of claim 2, and including switch means coupled to said circuit means for selectively actuating said circuit means to emit light of varying intensity whereby said focused light appears to be moving along said elongated pathway means in response to said switch means.

15. The illuminated toy of claim 14, wherein said switch means includes a manually actuated switch disposed on said handle.

16. An illuminated toy, comprising a handle, light source means mounted in said handle for emitting focused light of variable intensity, elongated light pathway means having a first end and a second end, said first end being mounted to said handle and optically coupled to said light source means for providing a pathway for said focused light; said focused light being focused in the direction of said second end of said elongated light pathway means; sound generating means mounted in said handle for producing a sound simultaneously with said light source means emitting said focused light; variable light intensity means for varying the intensity of said focused light so that said focused light appears to be moving along said pathway means; said pathway means being a light rod, said light rod emitting a visual effect of illumination of light with a light travel distance proportional to variations in the intensity of said emitted focused light; and said sound generating means generates a second sound associated with said light with deactivation of said sword simultaneously with deactivation of said light source means.

17. The illuminated toy claim 14, including a head coupled to said second end of said elongated light pathway means.

18. The illuminated toy of claim 17, wherein said light source means and said elongated light pathway means illuminate said head.

19. An illuminated toy, comprising a handle, light source means mounted in said handle for emitting focused light of varying intensity, elongated light pathway means having a first end and a second end, said first end being mounted on said handle and optically coupled to said light source means for providing a pathway for said focused light; said focused light being focused in the direction of said second end of said light pathway means; variable light intensity means coupled to said light source means for varying the intensity of said focused light so that said focused light appears to be moving along said elongated light pathway; sound generating means mounted in said handle for producing a sound simultaneously with said light source means emitting said focused light; said pathway means being a light rod, said light rod emitting a visual effect of illumination of light with a light travel distance proportional to the variations in intensity of said emitted focused light; and sound generating means generating a first sound associated with movement of said sword.

20. The illuminated toy of claim 19, including a head coupled to said second end of said elongated light pathway means.

21. The illuminated toy of claim 20, wherein said light source means and said elongated light pathway means illuminate said head.

22. An illuminated toy, comprising a handle, light source means mounted in said handle for emitting focused light, light pathway means having a first end and a second end, said first end being mounted at or about said handle and optically coupled to said light source means for providing a light pathway for said focused light; said focused light being focused in the direction of said second end of said pathway means, and variable light intensity means for varying the intensity of said focused light so that said focused light appears to be moving along said light pathway.

* * * * *